US006220002B1

(12) United States Patent
Savigny et al.

(10) Patent No.: US 6,220,002 B1
(45) Date of Patent: Apr. 24, 2001

(54) BAG-LOADING MACHINE AND BAG-FILLING MACHINE AND COMBINATION THEREOF AND RELATED METHOD

(75) Inventors: Edward B. Savigny, Newfane; James G. Savigny, Youngstown, both of NY (US)

(73) Assignee: Ag-Pak, Inc., Gasport, NY (US)

( * ) Notice: Subject to any disclaimer, the term of this patent is extended or adjusted under 35 U.S.C. 154(b) by 0 days.

(21) Appl. No.: 09/579,583

(22) Filed: May 26, 2000

Related U.S. Application Data

(62) Division of application No. 09/232,932, filed on Jan. 19, 1999, now Pat. No. 6,094,891.

(51) Int. Cl.[7] ..... B65B 43/18

(52) U.S. Cl. ..... 53/571; 53/284.7; 53/385.1; 53/386.1; 53/253; 141/316

(58) Field of Search ..... 53/250, 253, 284.7, 53/385.1, 386.1, 389.1, 570, 571, 573; 141/144, 145, 166, 314, 316

(56) References Cited

U.S. PATENT DOCUMENTS

| | | | | |
|---|---|---|---|---|
| 2,054,279 | * | 9/1936 | Briggs | 53/253 |
| 2,234,951 | | 3/1941 | Belcher | 53/570 |
| 2,654,518 | | 10/1953 | Kindseth | 226/55 |
| 2,700,496 | | 1/1955 | Dickey | 53/253 |
| 2,784,749 | | 3/1957 | Baker | 141/314 |
| 2,833,097 | | 5/1958 | Petrea et al. | 53/188 |
| 2,859,036 | | 11/1958 | Petrea et al. | 53/570 |
| 2,950,589 | | 8/1960 | Litchard | 53/190 |
| 2,973,612 | | 3/1961 | McGowan | 53/573 |
| 3,097,459 | | 7/1963 | Rausch | 53/59 |
| 3,112,777 | * | 12/1963 | Lohse | 53/570 |
| 3,225,514 | | 12/1965 | Inglett | 53/571 |
| 3,406,727 | | 10/1968 | Rexus | 141/131 |
| 3,416,620 | | 12/1968 | McClusky | 177/123 |
| 3,495,378 | * | 2/1970 | Kipers | 53/571 |
| 3,540,497 | | 11/1970 | Troyer | 141/314 |
| 3,842,569 | | 10/1974 | McClelland et al. | 53/37 |
| 3,961,461 | | 6/1976 | Ruf et al. | 53/188 |
| 4,078,358 | | 3/1978 | Henderson | 53/573 |
| 4,156,334 | | 5/1979 | Burgat et al. | 53/385 |

(List continued on next page.)

*Primary Examiner*—John Sipos
(74) *Attorney, Agent, or Firm*—Joseph P. Gastel

(57) ABSTRACT

A bag-loading machine and a bag-filling machine and combination thereof, the bag-loading machine including bag-carrying frame, a first motor coupled to the bag-carrying frame for moving it between a lower and a higher position, a bag-opening frame, a second motor for moving the bag-opening frame between an away position an a toward position wherein it pulls the front side of a bag away from the rear side while the bag-carrying frame is in its lower position, a blower mounted on the bag-carrying frame for maintaining the front side of the bag away from the rear side, the bag-filling machine including a second blower for blowing the bag to a fully opened position preceding the movement of first and second closed pads on a conveyor trough over the fully opened bag, the first motor thereafter moving the bag-carrying frame to its upper position so that the first and second closed pads are received within the open mouth of the bag, a third motor on the conveyor trough thereafter moving the first pad to clamp the front side of the bag between the first pad and an abutment on the conveyor trough and simultaneously causing the rear side of the bag to be detached from the bag-carrying frame so that it engages the second pad, the first motor thereafter lowering the bag-carrying frame after the rear side of the bag is forced against the second pad, a fourth motor on the conveyor trough for moving a third pad into engagement with the second pad with the rear side of the bag there-between, filling the bag, releasing the filled bag from the conveyor trough, and a control system for effecting the foregoing sequence of operations.

11 Claims, 14 Drawing Sheets

U.S. PATENT DOCUMENTS

| | | | |
|---|---|---|---|
| 4,389,834 | 6/1983 | Wysocki | 53/570 |
| 4,526,214 | 7/1985 | McGregor | 141/59 |
| 5,001,889 | 3/1991 | Mueller | 53/502 |
| 5,056,299 | 10/1991 | Furukawa et al. | 53/571 |
| 5,119,615 | 6/1992 | Kujubu et al. | 53/573 |
| 5,201,166 | 4/1993 | Johnsen | 53/571 |
| 5,331,792 | 7/1994 | Kitchen | 53/502 |
| 5,485,714 | 1/1996 | Montalvo | 53/585.1 |
| 5,555,709 | 9/1996 | Savigny et al. | 53/570 |

* cited by examiner

Fig. 2.
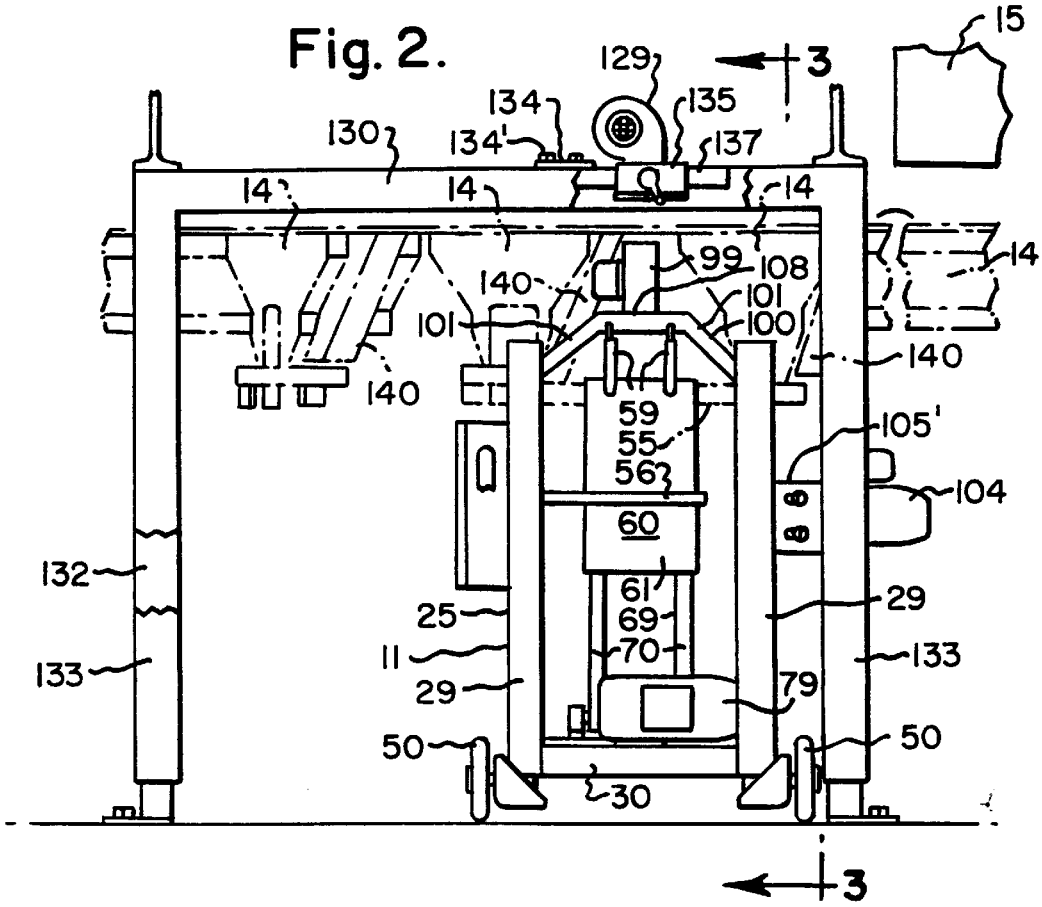
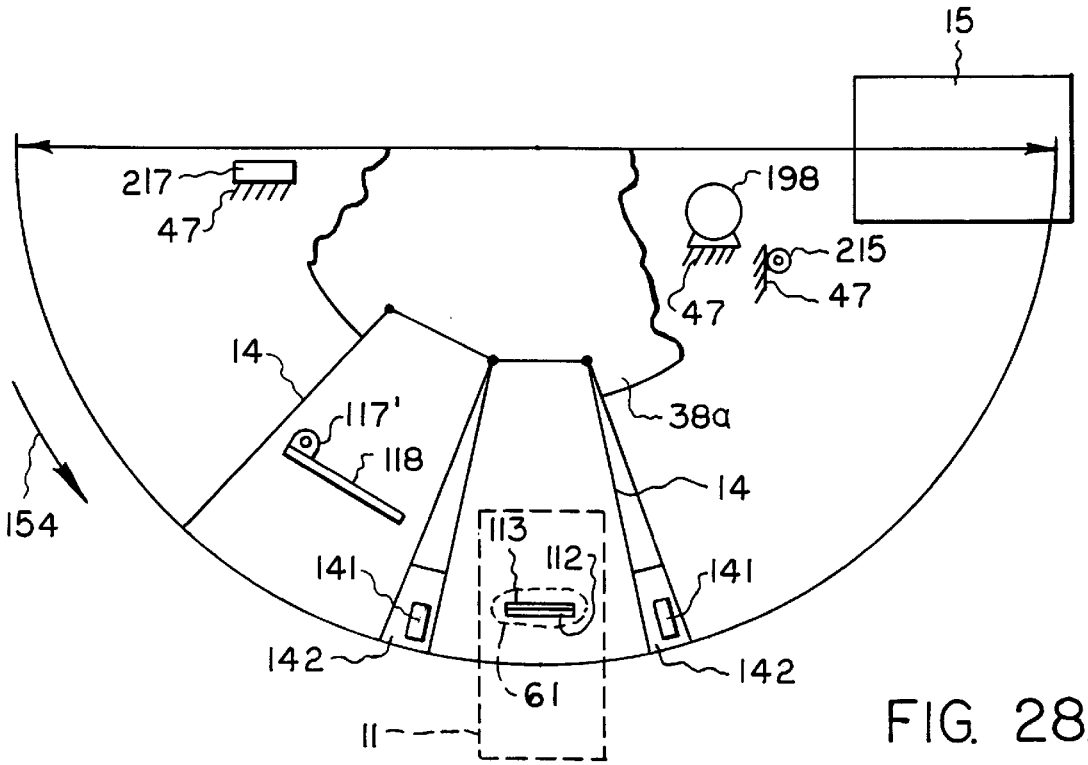
FIG. 28.

29
100
101
58
59
55
48
52
53
54
46
56
60
61
65
129
135
137
138
136
152
151
149
147
143
142
141
150
144
145
21
23
14
154
171
170
172
20A
160
161
167
164
168
163
165
124
122
153
20B
22
127
125
123
117'
86
112
118
140

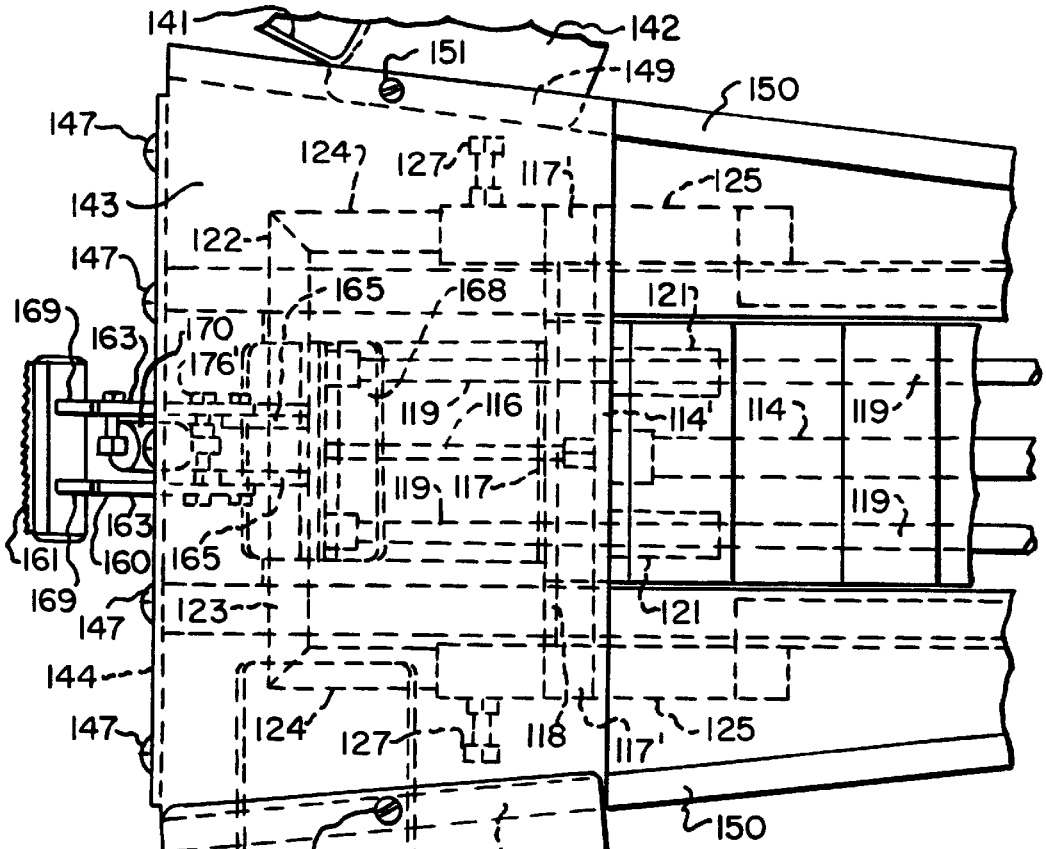
Fig. 21.
Fig. 22.
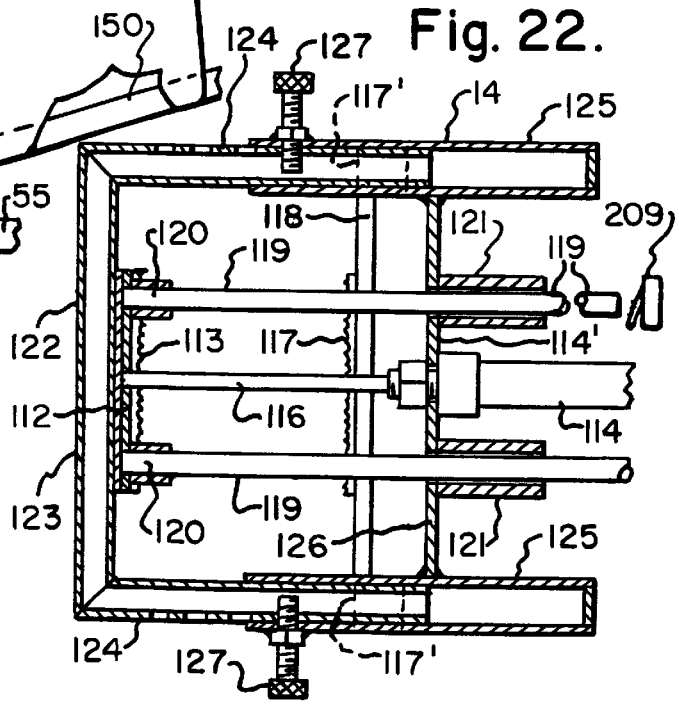
Fig.19B.
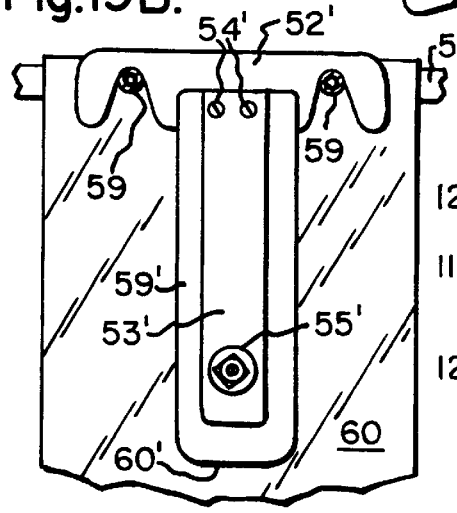

20C
20D
20D
20C
161
163
176
176'
165
167
123
112
172
168
127
124
125
113
117
114'
117'
118
86
36
28
125
37'
114
119
26
209
207
205
214
36'
63a
38a
43a
67a
67b
35'
47
14
116
121
122
35'

BAG-LOADING MACHINE AND BAG-FILLING MACHINE AND COMBINATION THEREOF AND RELATED METHOD

CROSS-REFERENCE TO RELATED APPLICATIONS

The present application is a division of application Ser. No. 09/232,932, filed Jan. 19, 1999, is now U.S. Pat. No. 6,094,891.

STATEMENT REGARDING FEDERALLY SPONSORED RESEARCH OR DEVELOPMENT

Not Applicable

BACKGROUND OF THE INVENTION

The present invention relates to an improved bag-loading machine and to an improved bag-filling machine and to a combination thereof and to an improved method for loading bags onto a carousel-type of bag-filling machine.

By way of background, carousel-filling machines are known in the art, as exemplified by U.S. Pat. No. 5,555,709. In the past, bags were manually loaded onto this type of machine while it was rotating. However, insofar as known, there was no efficient way of automatically loading bags onto a rotating carousel-type of bag-filling machine.

BRIEF SUMMARY OF THE INVENTION

It is one object of the present invention to provide an improved bag-loading machine for automatically loading bags onto a continuously rotating carousel-type of bag-filling machine.

Another object of the present invention is to provide a carousel-type of bag-filling machine having improved structure which permits it to be used in conjunction with an automatic bag-loading machine which loads bags onto the carousel-filling machine while the latter continuously rotates.

A further object of the present invention is to provide a method of automatically loading bags onto a continuously rotating carousel-type of bag-filling machine. Other objects and attendant advantages of the present invention will readily be perceived hereafter.

The present invention relates to a bag-loading machine comprising a main frame, a bag-carrying frame mounted on said main frame, a bag-opening frame mounted on said main frame, a first motor mounted on said main frame, a first linkage coupling said first motor to said bag-opening frame, a vacuum hose carried by said bag-opening frame, a second motor mounted on said main frame, a second linkage coupled between said second motor and said bag-carrying frame, and a blower mounted on said bag-carrying frame.

The present invention also relates to a bag-loading machine as set forth in the preceding paragraph in combination with a bag-filling machine, a bag-filling machine frame on said bag-filling machine, a second blower on said bag-filling machine frame, a movable trough-carrying member on said bag-filling machine frame, a trough on said trough-carrying frame, an air duct coupled relative to said trough, and said air duct being movable with said trough to a position between said second blower and said bag-carrying frame.

The present invention also relates to a conveyor trough of a carousel-type of bag-loading machine comprising a trough frame, spaced sides extending upwardly from said trough frame, a conveyor between said spaced sides, inner and outer ends on said trough frame, a first pad fixedly mounted on said outer end of said trough frame, a second pad on said trough frame between said first pad and said inner end of said trough frame, an abutment on said trough frame between said second pad and said inner end of said trough frame, a first motor coupled to said second pad for moving said second pad toward and away from said first pad and into and out of engagement with said abutment, a third pad, and a second motor mounted on said outer end of said trough frame and coupled to said third pad for moving said third pad into and out of engagement with said first pad.

The present invention also relates to a carousel-type of bag-filling machine comprising a frame, a plurality of conveyor troughs mounted on said frame, each of said conveyor troughs including a trough frame, spaced sides extending upwardly from said trough frame, a conveyor between said spaced sides, inner and outer ends on said trough frame, a first pad fixedly mounted on said outer end of said trough frame, a second pad on said trough frame between said first pad and said inner end of said trough frame, an abutment on said trough frame between said second pad and said inner end of said trough frame, a first motor coupled to said second pad for moving said second pad toward and away from said first pad and into and out of engagement with said abutment, a third pad, and a second motor mounted on said outer end of said trough frame and coupled to said third pad for moving said third pad into and out of engagement with said first pad.

The present invention also relates to a method of loading bags onto a bag-filling machine having a plurality of conveyor troughs mounted on a continuously rotating carousel comprising the steps of mounting an assemblage of bags on a bag-loading machine proximate said carousel, initially opening a bag while it remains mounted on said bag-loading machine, blowing the bag to a fully open condition, raising the fully opened bag as a conveyor trough passes over it, and clamping the opposite sides of the bag to said conveyor trough.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 2 is a fragmentary end elevational view taken substantially in the direction of arrows 2—2 of FIG. 1;

FIG. 19A is a fragmentary view similar to FIG. 19 but showing another embodiment of a bag-carrying frame;

FIG. 19B is a fragmentary cross sectional view taken substantially along line 19B—19B of FIG. 19A;

FIG. 21 is a fragmentary plan view of the conveyor trough and bag-clamping mechanism taken substantially in the direction of arrows 21—21 of FIG. 20 and showing a portion of the bag-clamping mechanism;

FIG. 22 is a fragmentary cross sectional view taken substantially along line 22—22 of FIG. 20;

FIG. 28 is a schematic view showing the various relationships between the bag-opening machine and the conveyor troughs on the carousel bag-filling machine and the bag-weighing machine and other related structure.

DETAILED DESCRIPTION OF THE INVENTION

Figure 1:
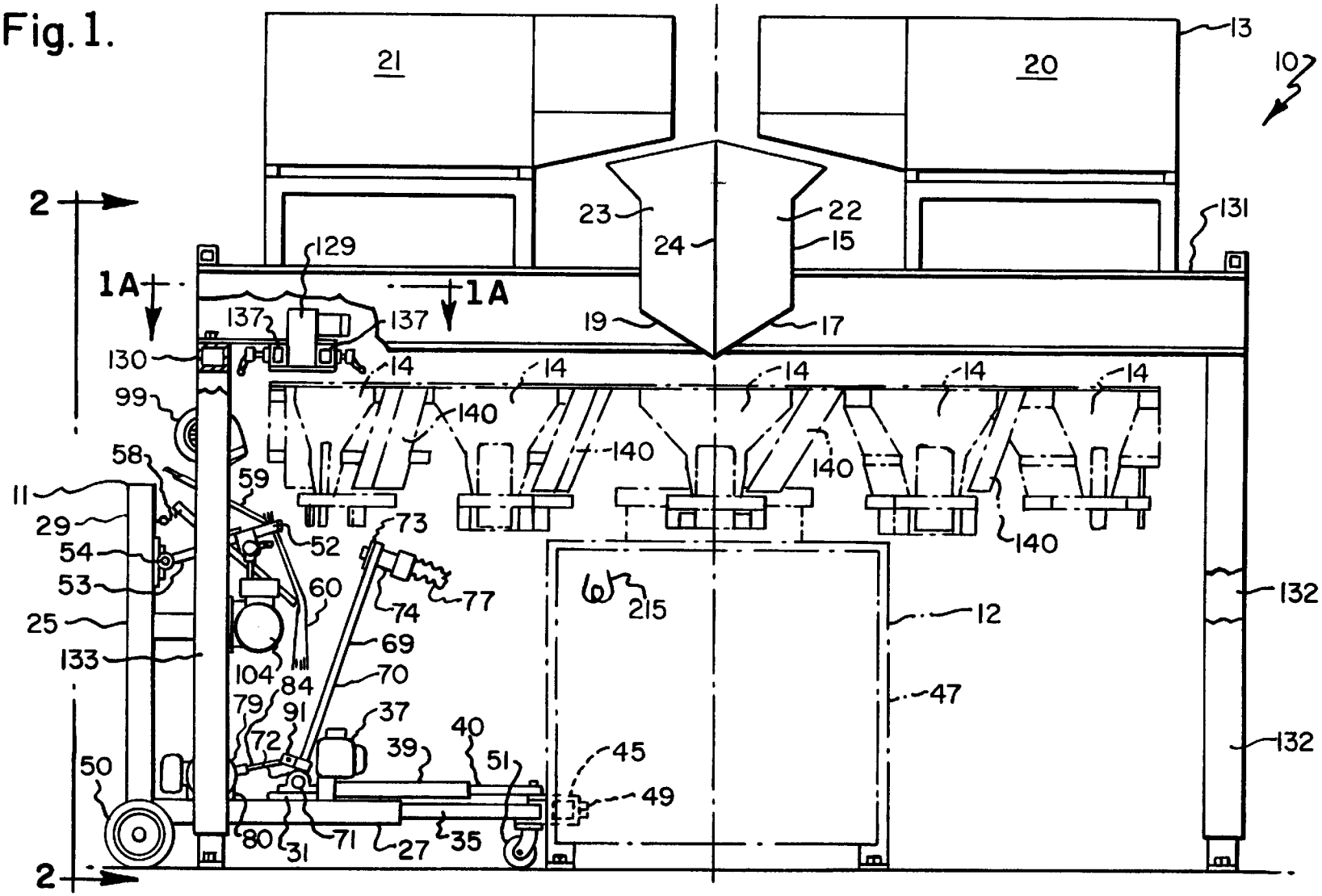
FIG. 1 is a fragmentary side elevational view, partially in phantom, of a combined produce-weighing, automatic bag-opening and bag-filling machine.

Summarizing briefly in advance, the combined machine 10 of the present invention includes an automatic bag-loading machine 11, a carousel bagging machine 12 and a produce-weighing and dispensing machine 13. The automatic bag-loading machine 11 automatically provides opened plastic bags to each of the conveyor troughs 14 of the continuously rotating carousel bagger 12 as they pass by the automatic bag-loading machine 11. A bag-clamping mechanism, which is described in detail hereafter, associated with each of the conveyor troughs 14, receives an opened bag from the automatic bag-loading machine and clamps the open bag onto each conveyor trough, and thereafter as each conveyor trough 14 passes underneath hopper 15 of the produce weighing and dispensing machine, one of the doors 17 or 19 of hopper 15 alternately opens to deposit a load of produce, such as potatoes, into the conveyor trough 14 which is then immediately below it. The sections 22 and 23 of hopper 15 receive the potatoes alternately from weighing machines 20 and 21, respectively. The weighing machines and hopper arrangements 15 are well known in the art and are schematically shown in U.S. Pat. No. 5,555,709 which is incorporated herein by reference. However, in its more specific aspects, weighers 20 and 21 alternately dump a weighed amount of potatoes into sections 22 and 23, respectively, of hopper 15. Sections 22 and 23 are separated by a partition 24. Weigher 20 dumps its weighed amount of potatoes into section 22, and weigher 21 alternately dumps a weighed amount of potatoes into section 23. As a conveyor trough 14 passes underneath hopper 15, one of the doors 17 will open to discharge its load into that hopper, and as the next conveyor trough 14 passes underneath hopper 15, the other door 19 will open to dump its load of produce into that conveyor trough. Each conveyor trough 14 will dump the produce into a bag which is clamped onto the conveyor trough, and, at a predetermined portion of the movement of the carousel, the bag of produce is removed from the carousel.

Figure 20D:
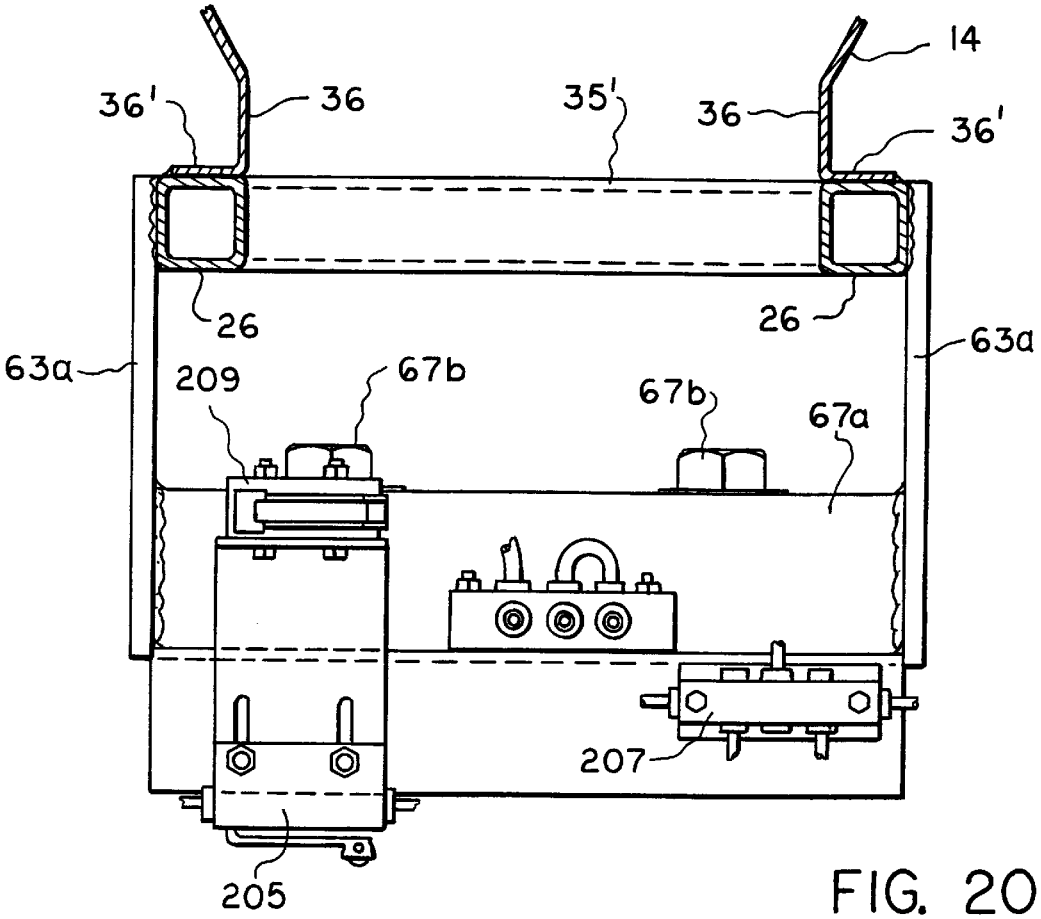
FIG. 20D is a cross sectional view taken substantially along line 20D—20D of FIG. 20B.

The weighers 20 and 21 are well known in the art and are products, in this particular instance, of the Newtec Manufacturing Company and they are identified by Model No. 2008. The carousel bagger 12 has a carousel rotating mechanism and conveyor drive mechanism which are substantially identical to these structures described in U.S. Pat. No. 5,555,709, which is incorporated herein by reference. More specifically, the carousel and conveyor drive structure is shown in FIGS. 2–5, 5A, 8 and 8A–8E of U.S. Pat. No. 5,555,709 and is described between column 4, line 19 to column 5, line 22 and between column 6, line 16 to column 6, line 39 of this patent. Each conveyor trough 14 has a pair of plates 63*a* (FIGS. 20B, 20C, 20D) which mount it on table 38*a* which is mounted on four rollers 43*a* which are mounted on frame 47. A tubular brace 67*a* has its opposite ends welded to plates 63*a*. Plates 63*a*, table 38*a*, rollers 43*a*, brace 67*a* and frame 47 correspond to plates 63, table 38, rollers 43, brace 67 and frame 39, respectively, of U.S. Pat. No. 5,555,709. Bolts 67*b* couple brace 67*a* to table 38*a*. Beams 26 are welded to the top edges of plates 63*a*, and downwardly extending struts 28 are welded to the remote ends of beams 26. The frame portions 125 (FIGS. 20B and 20C) are welded to the lower ends of struts 28. The sides 36 of conveyor troughs 14 have flanges 36' which are welded to the tops of beams 26. Tubular braces 35' and 37' have their opposite ends welded to beams 26. However, as will appear hereafter, the bag-clamping mechanism which is associated with each of the conveyor troughs 14 differs from that disclosed in U.S. Pat. No. 5,555,709. The carousel bagger 12 also differs from the carousel bagger disclosed in U. S. Pat. No. 5,555,709 in that it has twelve conveyor troughs 14 rather than the eight conveyor troughs shown in said patent. Additionally, the carousel rotates at about five revolutions per minute and thus the machine is capable of bagging sixty bags of produce per minute.

Figures 1A, 6:
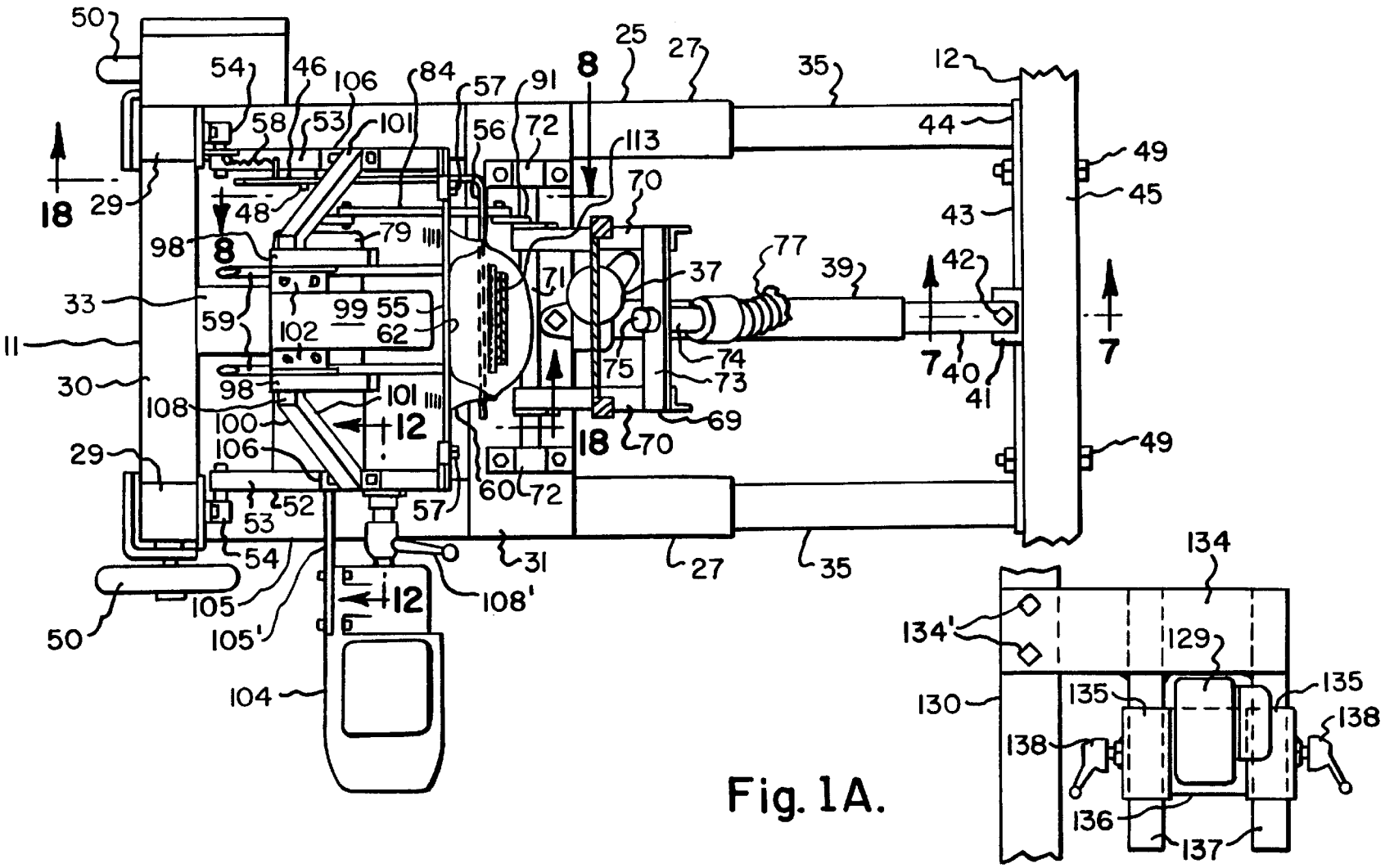
FIG. 1A is a fragmentary cross sectional view taken substantially along line 1A—1A of FIG. 1 and showing the mounting for the bag-opening blower.
FIG. 6 is a fragmentary view, partially in cross section, taken substantially along line 6—6 of FIG. 3.
Figure 7:
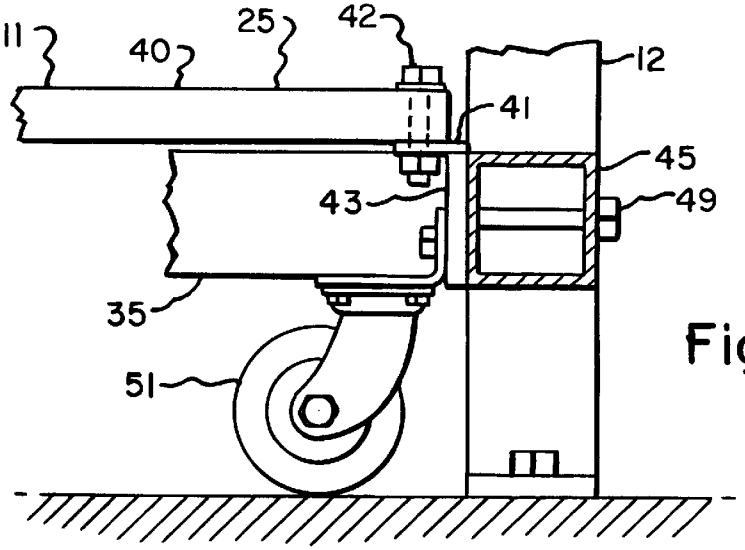
FIG. 7 is an enlarged fragmentary cross sectional view taken substantially along line 7—7 of FIG. 6 and showing the attachment between the bag-filling machine frame and the automatic bag-loading frame.
Figure 25:
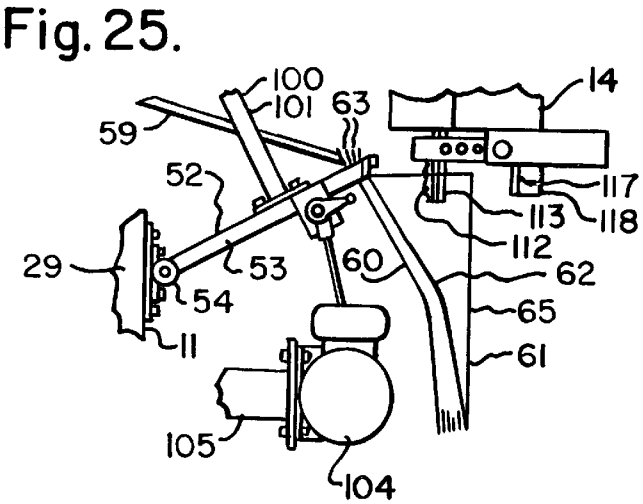
FIG. 25 is a schematic view showing the bag-carrying frame in its upper position with the clamping pads of the bag-clamping mechanism located in the open end of the bag.

The automatic bag-loading machine 11 (FIGS. 1–15) includes a frame 25 consisting of a pair of spaced horizontal members 27 (FIG. 6) and a pair of vertical posts 29 extending upwardly therefrom. A horizontal strut 30 (FIGS. 2, 4 and 6) extends between vertical posts 29. A plate 31 (FIGS. 4 and 6) has its opposite ends 32 secured across horizontal members 27. A plate 33 (FIG. 4) has one end welded to plate 31 and its opposite end 34 welded to strut 30. A pair of extension members 35 (FIGS. 1, 3, 6 and 7) are telescopically received in horizontal frame members 27. A motor 37 with a suitable gear drive is mounted on plate 31 and it has a linear actuator which includes an elongated threaded rod within tube 39 rotated by the gear reducer to cause a nut attached within rod 40 to move rod 40 in and out of tube 39 as required. Rod 40 has its outer end bolted to tab 41 by bolt 42 (FIGS. 6 and 7). Tab 41 is welded to plate 43 which has its opposite ends 44 welded to the ends of telescoping members 35. Thus, when motor 37 is actuated, telescoping members 35 can be moved in and out of horizontal members 27 to thereby vary the distance between plate 43 and the operating portions of the automatic bag loading machine 11, as required, to properly fit the bag-loading machine relative to the carousel bagging machine. Plate 43 is bolted by bolts 49 to frame member 45 (FIGS. 1, 3 and 6) of the frame 47 of the carousel bagger 12. Thus, the automatic bag-loading machine essentially becomes a part of the carousel bagger 12. However, it can be rolled away from the frame of the carousel bagger 12, after bolts 49 are unbolted, because it is mounted on rear wheels 50 at the junctions of frame members 27 and 29 and on front wheels 51 which are part of casters secured to the outer ends of telescoping extension members 35.

Figure 16:
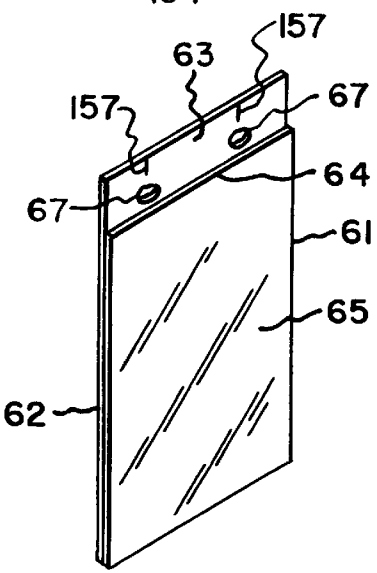
FIG. 16 is a perspective view of a plastic bag of the type which is carried by the bag-carrying frame.
Figure 8:
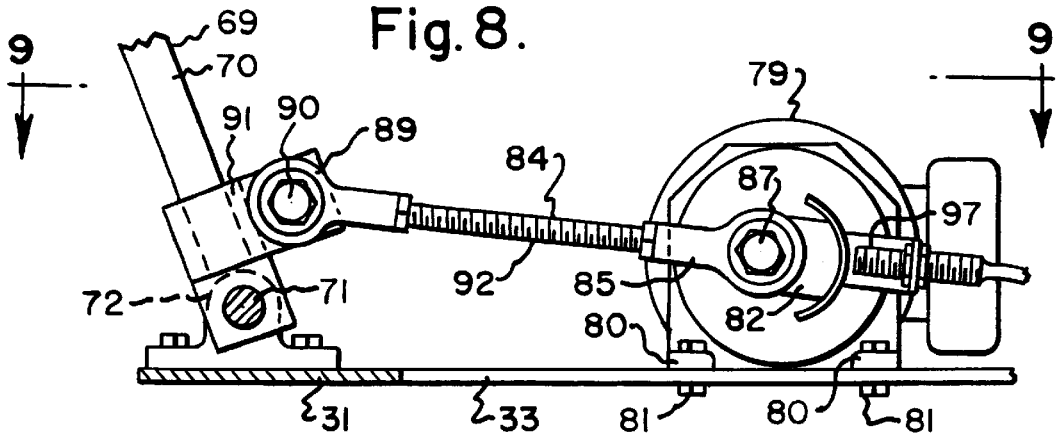
FIG. 8 is an enlarged fragmentary cross sectional view taken substantially along line 8—8 of FIG. 6 and showing the connection between the bag-opening frame and its driving motor with the bag-opening frame being in an away position remote from the bag-carrying frame.
Figure 9:
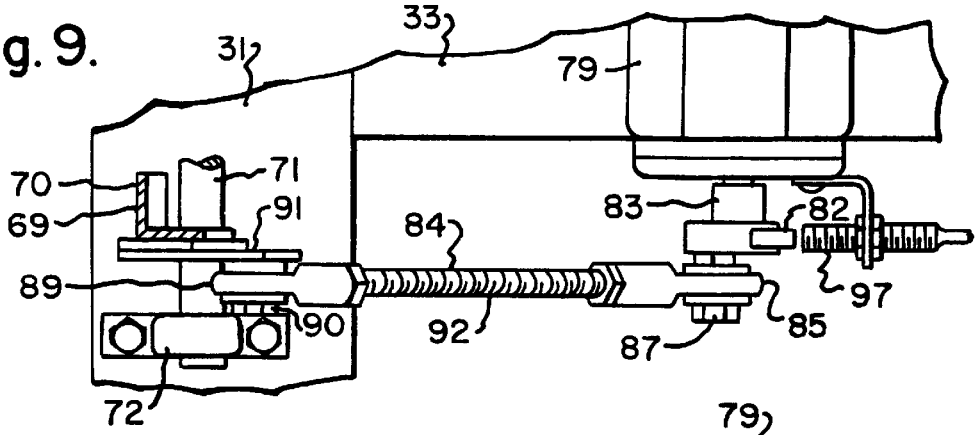
FIG. 9 is a fragmentary cross sectional view taken substantially along line 9—9 of FIG. 8.
Figure 10:
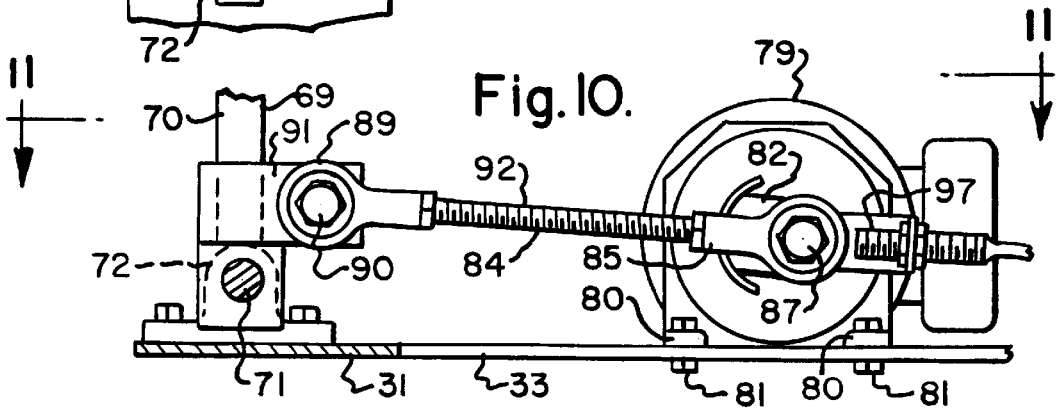
FIG. 10 is a view similar to FIG. 8 but showing the position of the bag-opening frame when it is in a toward position wherein it contacts the side of a bag which is to be opened.
Figure 11:
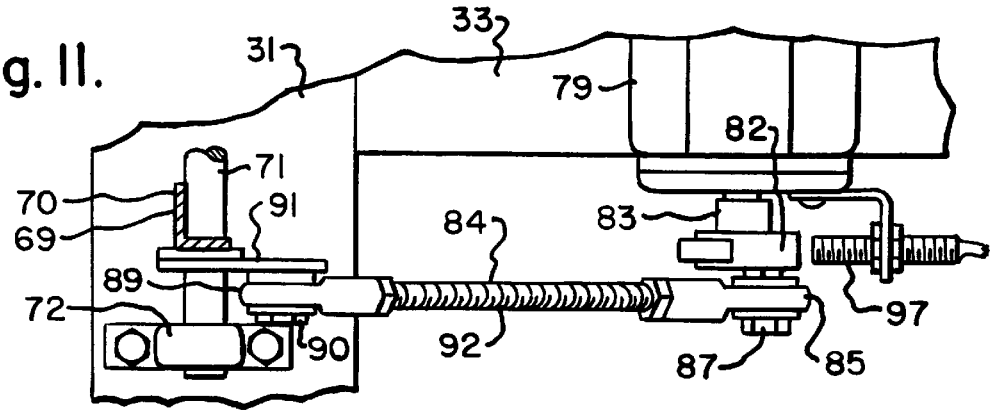
FIG. 11 is a fragmentary cross-sectional view taken substantially along line 11—11 of FIG. 10.

A bag-carrying frame 52 (FIGS. 1, 3, 6, 18, 19 and 25) is mounted on frame members 29. More specifically, bag-carrying frame 52 includes spaced arms 53 (FIG. 6) having their inner ends pivotally mounted in bearing structures 54 on frame members 29. A wicket bar 55 (FIGS. 2, 3, 3A and 6) is secured to the ends of arms 53 by bolts 57. Wicket rods 59 (FIGS. 1, 2, 3, 3A, 6, 18, 19 and 25) extend rearwardly and upwardly from wicket bar 55. An assemblage 60 of plastic bags 61 (FIG. 16) is mounted on wicket rods 59. In this respect each bag 61 has a rear side 62 which has an upper portion 63 which extends upwardly beyond the upper edge 64 of front side 65. The upper portion 63 has spaced holes 67 which receive the wicket rods 59.

A bag opening frame 69 (FIGS. 1, 2, 3, 6 and 17) has spaced parallel vertically extending frame members 70 which have their lower ends secured in spaced relationship on shaft 71, the opposite ends of which are mounted in bearings 72 (FIGS. 1, 3, 4 and 6) on plate 31. A plate 73 (FIGS. 1, 3, 6 and 17) has its opposite ends bolted across the upper ends of frame members 70 of bag-opening subframe 69. A tube 74 (FIGS. 3 and 6) extends through plate 73 with its open end 75 facing the bag assemblage 60. A vacuum hose 77 is in communication with tube 74 and is in communication with a suitable source of vacuum (not shown) which may be a vacuum pump mounted on bag-loading frame 11.

The bag-opening frame 69 is driven toward and away from the bag assemblage 60 by electric motor 79 (FIGS. 1–4, 6 and 8–11) which includes base members 80 (FIGS. 4, 8 and 10) which are bolted to plate 33 by bolts 81. A crank 82 is mounted on motor shaft 83, and an adjustable crank arm 84 (FIGS. 8–11) has end 85 pivotally mounted on crank pin 87 and its opposite end 89 pivotally mounted on pin 90 extending outwardly from arm 91 secured to a frame member 70 of bag-opening frame 69. The central portion 92 of crank arm 84 is threaded so that it essentially constitutes a turnbuckle structure in conjunction with rod ends 85 and 89 to thus adjust the throw of bag-opening frame 69.

A structure is provided on bag-carrying frame 52 for biasing the assemblage 60 of bags 61 toward bag-opening frame 69. A lever 46 (FIGS. 3, 18 and 19) is pivotally mounted at 48 on one of the arms 53 (FIGS. 18, 19 and 6), and it has a lower horizontal bar 56 (FIGS. 18, 19, 6 and 2) which is biased across the rear of bag assemblage 60 by spring 58 which connects the upper portion of lever 46 to vertical post 29. The positions of lever 46 in the lower and higher positions of bag-carrying frame 53 are shown in FIGS. 18 and 19, respectively.

Figures 18, 19, 20:
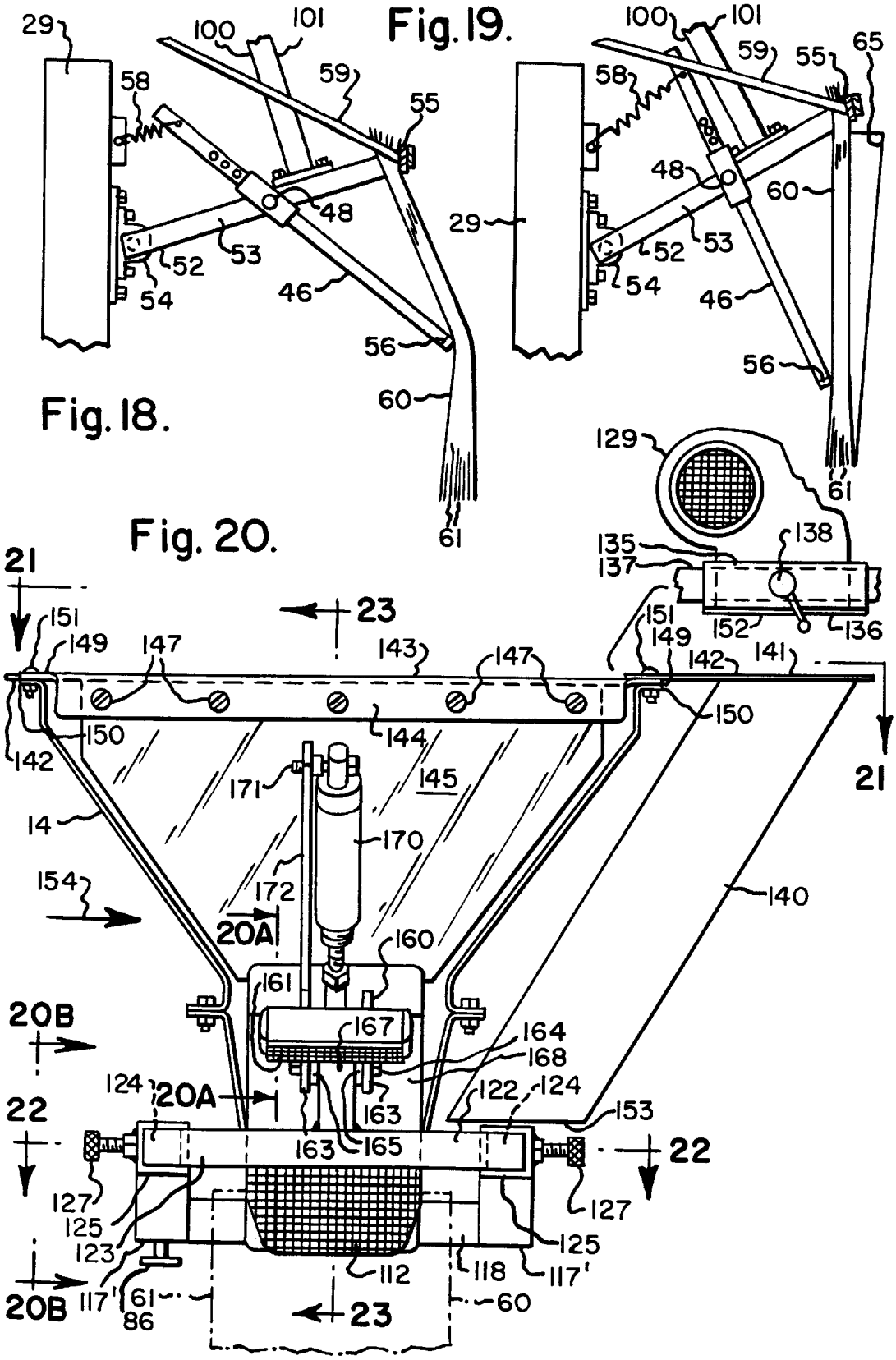
FIG. 18 is a fragmentary cross sectional view taken substantially along line 18—18 of FIG. 6 and depicting the bag-carrying frame in its lower position.
FIG. 19 is a view similar to FIG. 18 but depicting the bag-carrying frame in its upper position.
FIG. 20 is an enlarged fragmentary end elevational view of a conveyor trough mounting the bag-clamping mechanism and also showing the blower motor mounted on the main frame of the bag-filling machine.

In FIGS. 19A and 19B an alternate and preferred structure is provided for biasing the assemblage of bag 61 toward bag-opening frame 69. Certain numerals in FIGS. 19A and 19B correspond to structure previously described relative to FIGS. 18 and 19 and therefore these items of structure will not be further described. The embodiment of FIGS. 19A and 19B includes a plastic yoke 52' which straddles wicket rods 59. A metal plate 53' is attached to yoke 52' by screws 54'. A cylindrical weight 55' is mounted on rod 57' which is mounted on plate 53', and the end of rod 57' bears against flexible resilient plate 59', the lower end 60' of which bears against bag assemblage 60.

The operation of the various parts of the entire system is controlled by programmable logic controller 94 (FIG. 29) (hereafter PLC) which is energized when switch 96 is closed. Thereafter, a circuit is completed through PLC 94 to bag-carrying frame motor 104 (FIGS. 1–3, 5, 6, 12–15 and 29) to cause the bag-carrying frame 52 to be in its lower position. Once this has been accomplished, the bag-loading procedure may commence, as described hereafter.

Figures 3, 3A, 17:
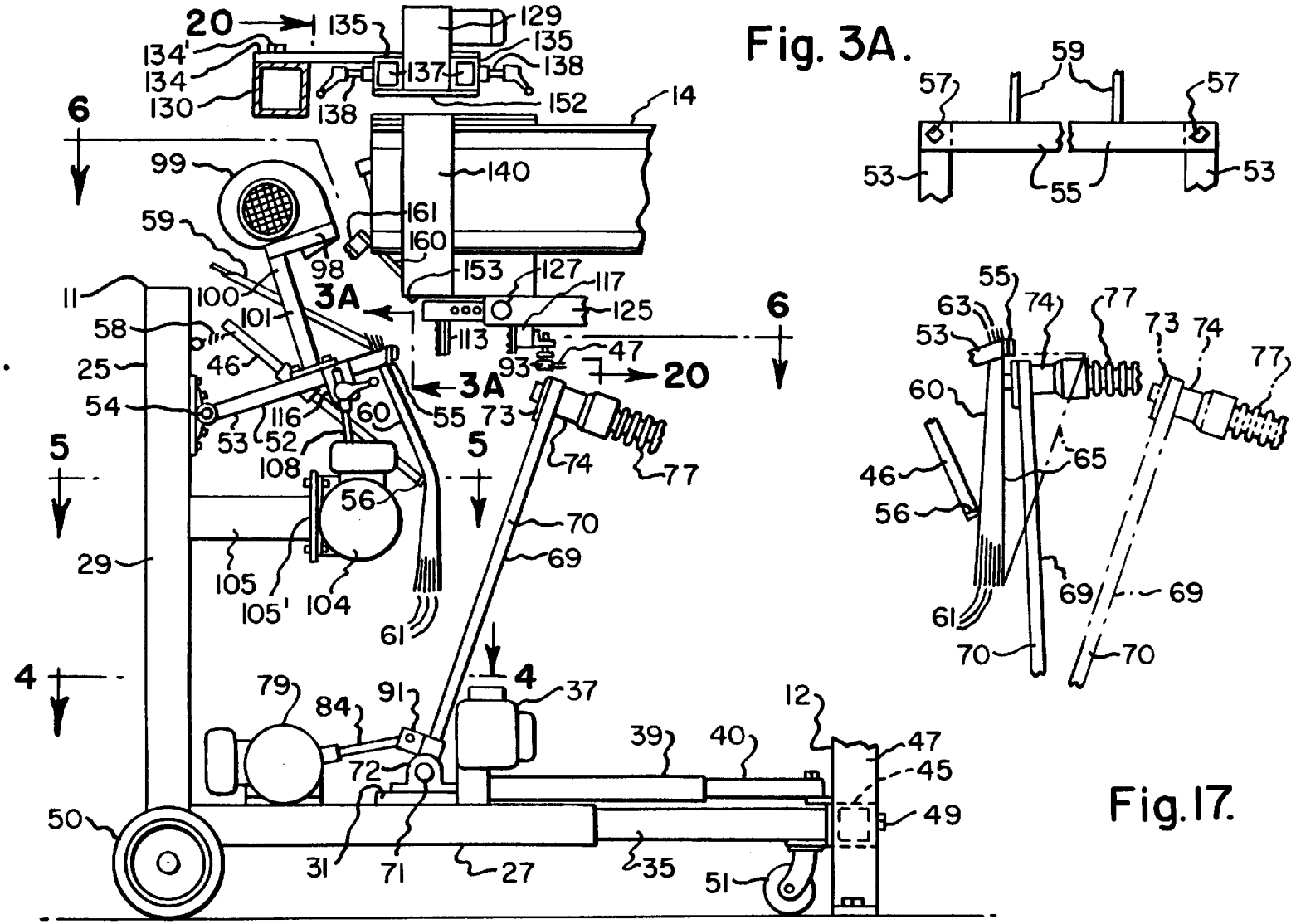
FIG. 3 is a fragmentary cross sectional view taken substantially along line 3—3 of FIG. 2.
FIG. 3A is a fragmentary view of the wicket plate taken substantially in the direction of arrows 3A—3A of FIG. 3.
FIG. 17 is a fragmentary schematic side elevational view of the bag-opening frame showing its away position in phantom and showing its toward position wherein the suction tube contacts the short side of a bag mounted on the bag-carrying frame.
Figure 5:
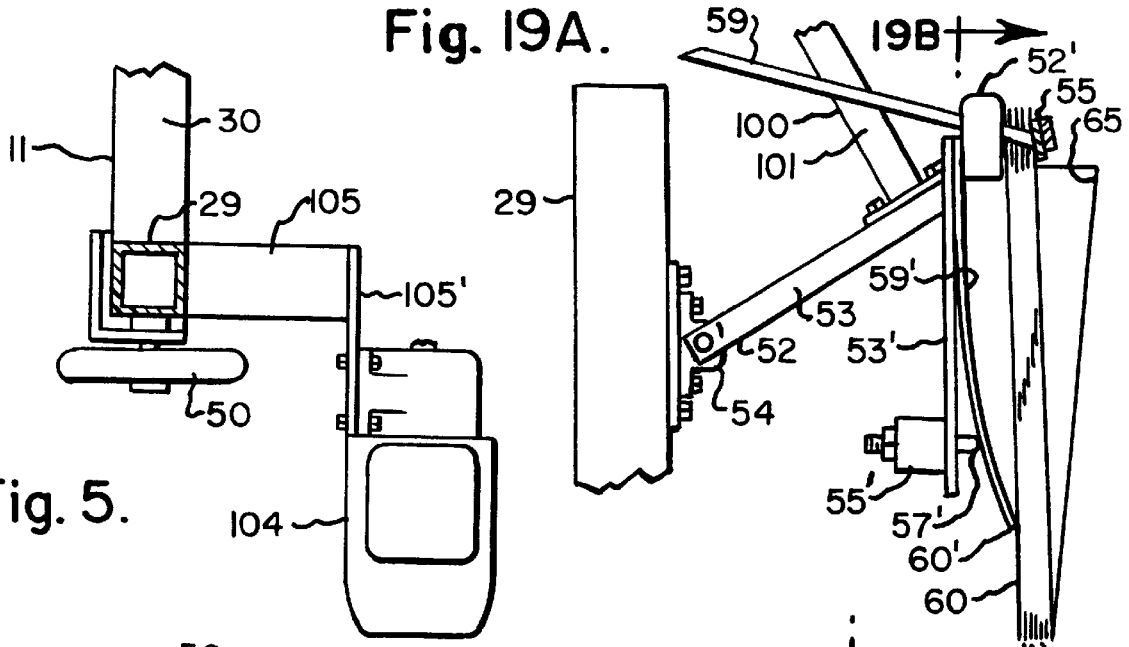
FIG. 5 is a fragmentary cross sectional view taken substantially along line 5—5 of FIG. 3 and showing the mounting for the motor for moving the bag-carrying frame between its lower and upper positions.
Figure 4:
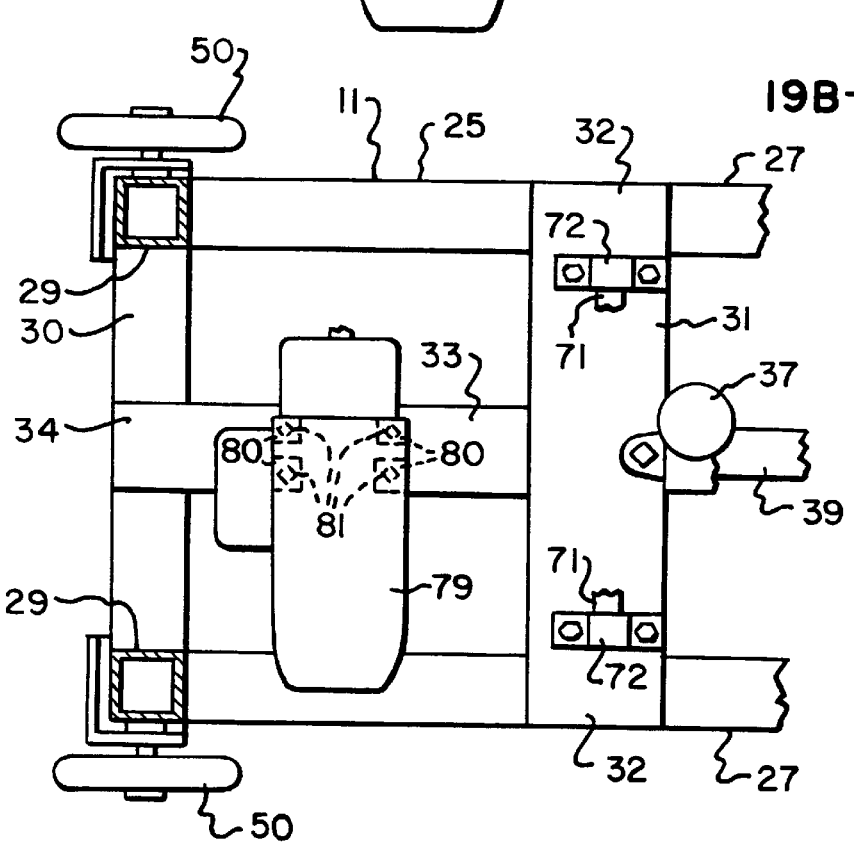
FIG. 4 is a fragmentary cross sectional view taken substantially along line 4—4 of FIG. 3 and showing the mounting of the motor for driving the bag-opening frame toward and away from the bag-carrying frame.
Figure 27:
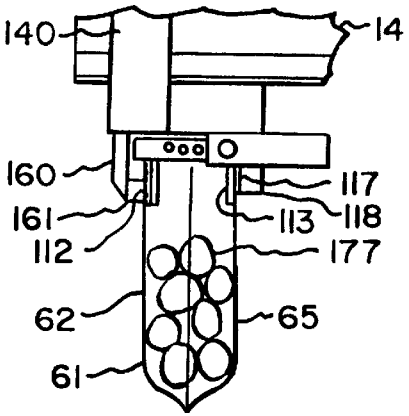
FIG. 27 is a view similar to FIG. 26 and showing the clamped opened bag after it has received produce from the conveyor trough.

At the beginning of a bag-opening cycle and while the carousel bagger 12 is rotating, the bag-opening frame 69 is in an away position of FIGS. 3 and 6, and the bag-carrying frame 52 is in its lower position of FIGS. 3 and 18. A proximity switch 93 (FIGS. 3, 23, 24, 28 and 29) is mounted on the frame 47 of the carousel bagger 12, and when the head of adjustable metal screw 86 mounted on a strut 117' (FIGS. 20B, 20C and 23) of each conveyor trough 14 passes in proximity thereto, switch 93 will close to complete a circuit to PLC 94 to thereby cause the PLC 94 to internally complete a circuit to bag-opening frame motor 79. This will energize motor 79 to rotate its shaft 83 360° from its position in FIG. 8 back to its position in FIG. 8 where it will stop because proximity switch 97 will cause PLC 94 to open a circuit to motor 79, which is of the type which has an internal braking system which causes it to stop at the precise position where frame 69 is in its farthest position away from the bag-carrying frame 52. Motor 79 is of the type which is manufactured by SEW Eurodrive and is Model No. R32DT71D4BM. When the bag-opening frame 69 is at its midway 180° position it will occupy the position of FIG. 10, and at this time the open end 75 of tube 74 will engage the short side 65 of plastic bag 61 and pull it away from its rear side 62. The total time required for the 360° rotation of the motor shaft 83 is approximately 0.28 seconds. Thus, at this point the front side 65 of the bag 61 is pulled away so that the bag is partially opened while its rear side 62 remains mounted on the wicket rods 59.

A blower 99 produces a current of air which blows into bag 61, at this point, to retain the short side 65 away from the rear side 62. Blower 99 is mounted on frame 100. More specifically, legs 101 (FIG. 6) of frame 100 have their lower ends bolted at 106 to sides 53 of bag-carrying frame 52, and blower 99 is mounted on plates 102 (FIG. 6) which are secured to bars 98 (FIGS. 3 and 6) which extend outwardly from bar 108 (FIGS. 2 and 6) which extends across the upper ends of legs 101.

As the carousel 12 continues to rotate a conveyor trough 14 toward a position over an open bag 61, a second continuously operating blower 129 (FIGS. 1, 1A, 2, 3 and 20), which is driven by an electric motor, blows air into bag 61 to blow it to a fully open position. Blower 129 is mounted on horizontal frame member 130 (FIGS. 1A and 2) of main frame 131 which mounts the produce-weighing and dispensing machine 13. In this respect, main frame 131 includes two legs 132 and two legs 133. Frame member 130 is located at the upper ends of legs 133 (FIG. 2). In its more specific aspects, blower 129 is suitably mounted on a plate 134 (FIG. 1A) which is bolted by bolts 134' to frame member 130. Blower 129 is actually mounted on plate 136 which is attached to sleeves 135 (FIGS. 1A, 2 and 20) which are movable to adjusted positions on spaced bars 137 mounted on plate 134 and retained in position by set screws 138.

As the conveyor trough continues its rotation, blower 129 directs its air into a duct 140 (FIGS. 1, 3, 20 and 21) which is mounted at its upper end on plate 142. The duct 140 has an open upper end 141 which is flush with plate 142, the opposite edges of which are bolted to flanges 150 of adjacent conveyor troughs 14 by bolts 151 (FIG. 21). A clear plastic plate 143 (FIGS. 20, 21, 23 and 24) has a flange 144 which is bolted to plastic flap 145 of conveyor trough 14 by a plurality of bolts 147. The edges 149 of plate 143 are bolted to flanges 150 (FIG. 20) of conveyor trough 14 by bolts 151. Blower 129 has an outlet 152 (FIG. 20), and the open end 141 of duct 140 passes underneath blower outlet 152 as the carousel rotates. Thus, a stream of air produced by blower 129 will pass into duct 140 and the lower open end 153 of duct 140 (FIGS. 3 and 20) will direct this air into the opened bag 61 to inflate it to a fully opened condition with short side 65 of the bag away from rear side 62 preparatory to clamping the bag to the conveyor trough 14. Blower 129 operates continuously, and plates 143 and 141 prevent its air stream from being directed toward bag 61 except through duct 140. At this point, it is to be again noted that each conveyor trough 14 has a plate 143 thereon and that a plate 142 extends between each pair of adjacent conveyor troughs 14 and has its opposite edges secured to flanges 150 by bolts 151 (FIGS. 20 and 21).

Figure 12:
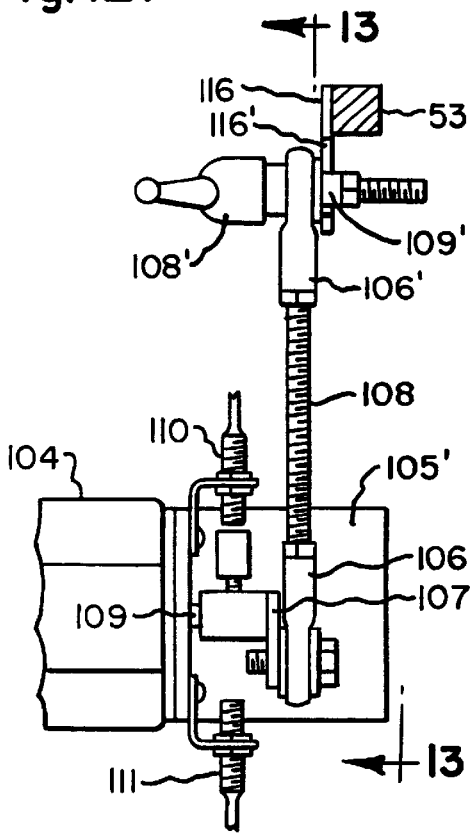
FIG. 12 is a fragmentary view, partially in cross section, taken substantially along line 12—12 of FIG. 6 and showing the linkage between the bag-carrying frame and its driving motor when the bag-carrying frame is in its lower position.
Figure 14:
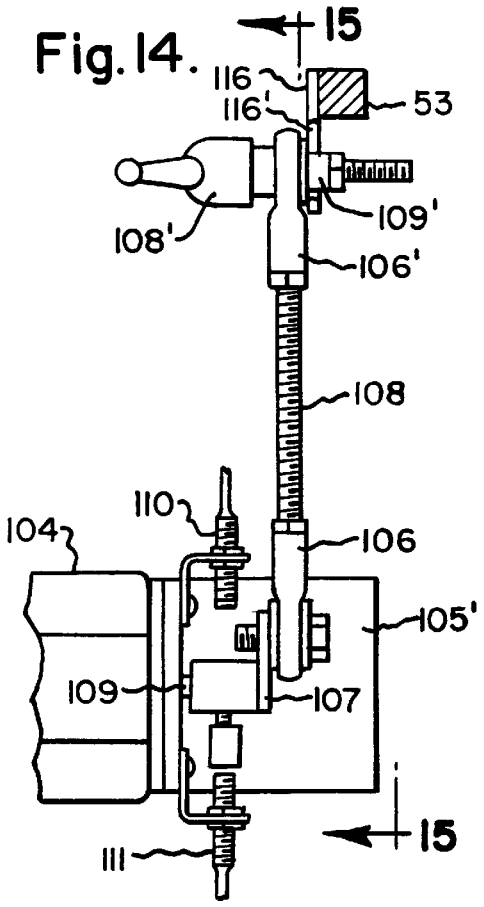
FIG. 14 is a view similar to FIG. 12 but showing the position of the linkage when the bag-carrying frame is in its upper position.
Figure 13:
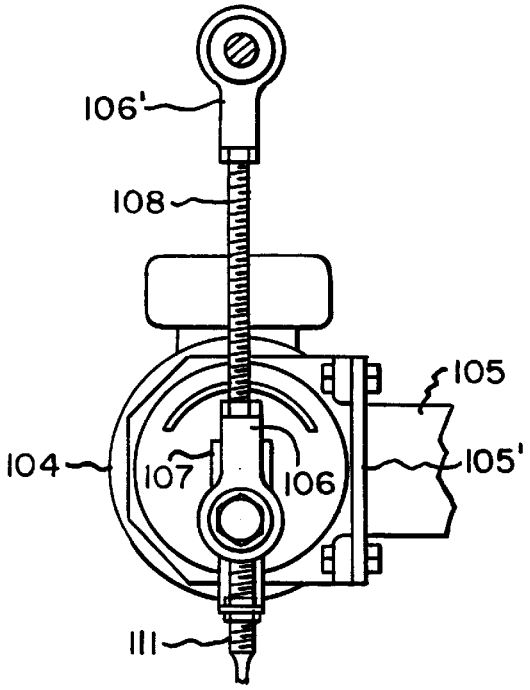
FIG. 13 is a fragmentary cross sectional view taken substantially along line 13—13 of FIG. 12.
Figure 15:
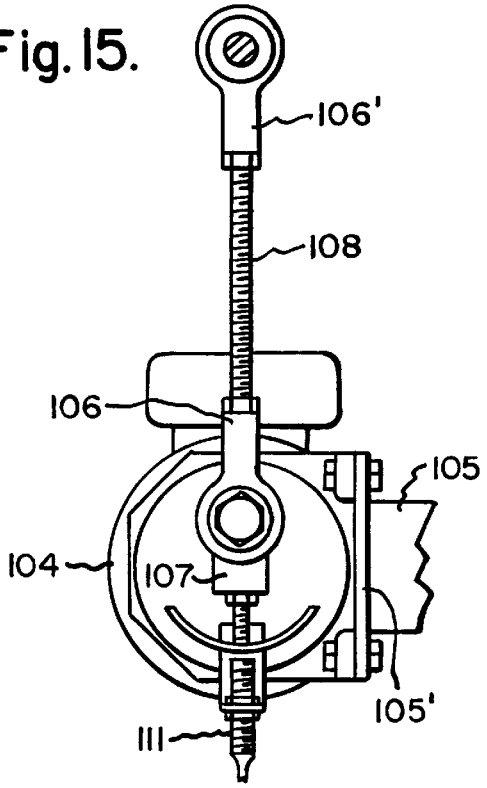
FIG. 15 is a cross sectional view taken substantially along line 15—15 of FIG. 14.
Figure 23:
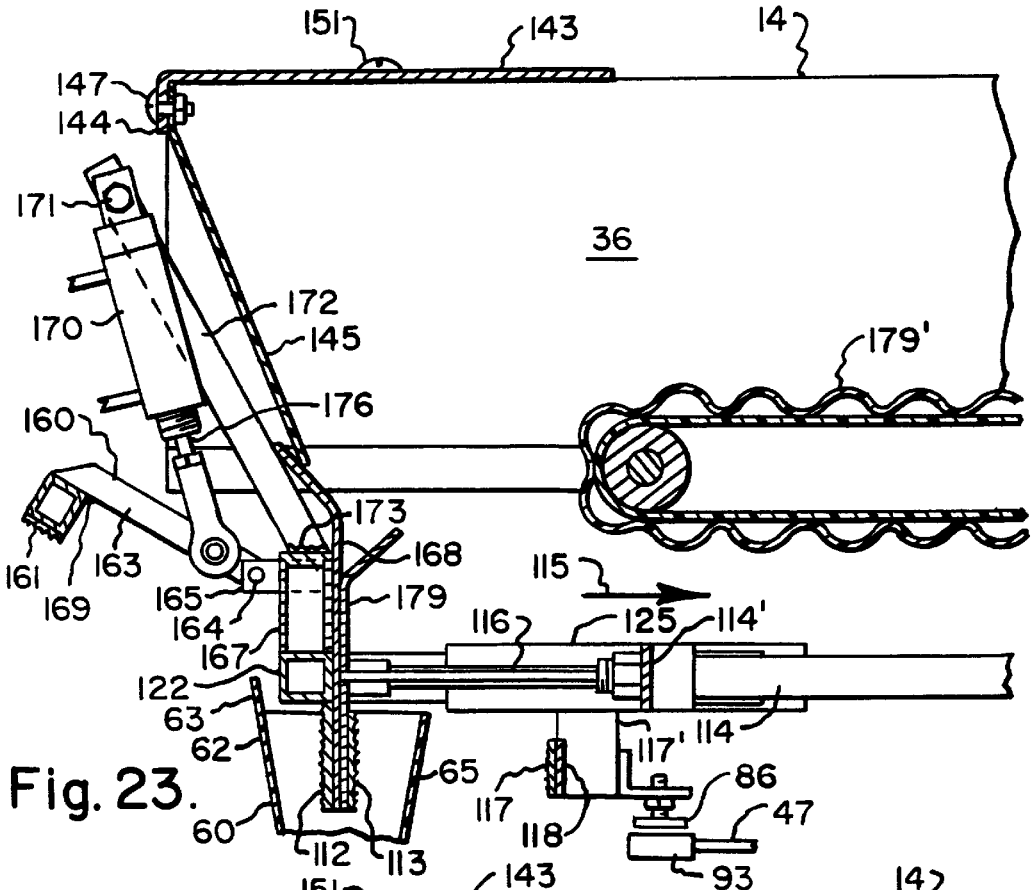
FIG. 23 is a fragmentary cross sectional view taken substantially along line 23—23 of FIG. 20 and showing primarily the bag-clamping mechanism in a position for receiving an opened bag mounted on the bag-carrying frame.
Figure 24:
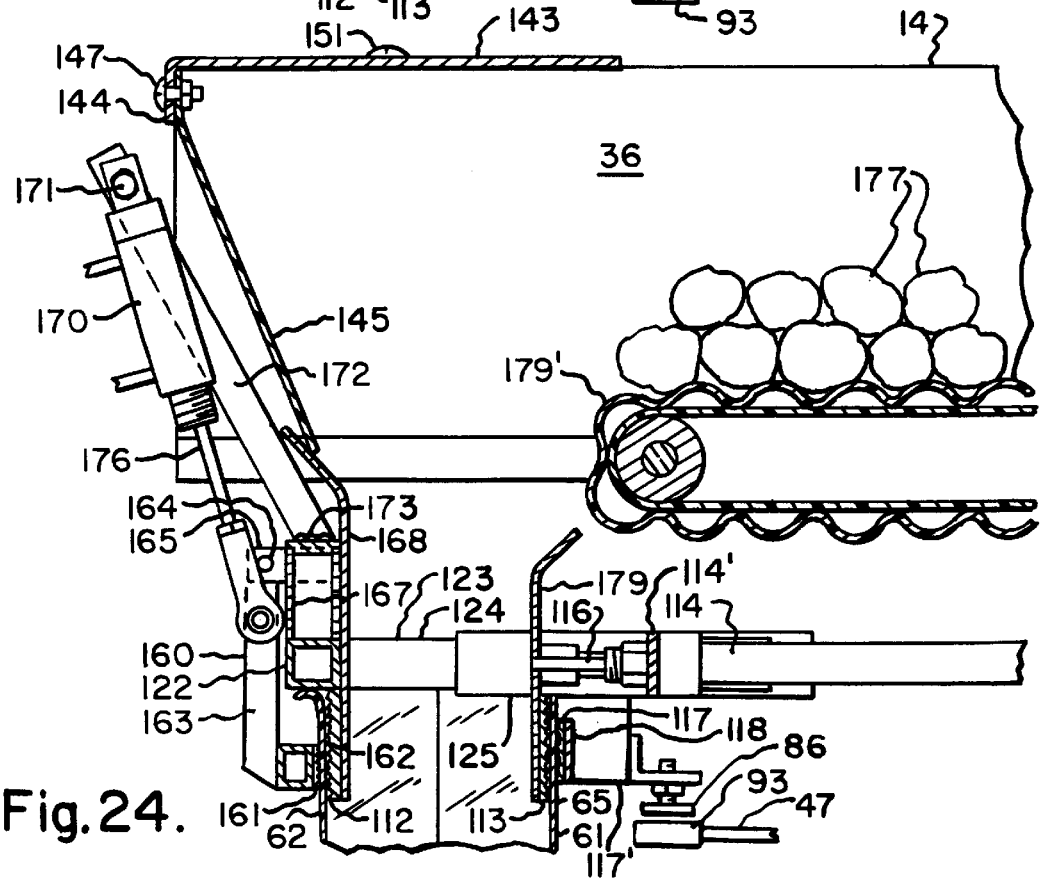
FIG. 24 is a view similar to FIG. 23 but showing a bag clamped onto the outlet of the conveyor trough by the bag-clamping mechanism.

The carousel rotates in the direction of arrow 154 in FIGS. 20 and 28. Thus, the air from duct 140 will be applied to the opened bag 61 before the clamping pads 112 and 113, which are in a back-to-back closed condition on the conveyor trough 14, reach the opened bag 61. The air from duct 140 will thus maintain the bag 61 in a fully blown open condition. The carousel, in its rotation, will move the conveyor trough 14 to a position wherein it approaches alignment with the automatic bag-loading machine 11. As the carousel reaches a position wherein the closed pads 112 and 113 reach the initial portion of the open mouth of bag 61, and while the carousel continues to rotate, a timer circuit within PLC 94 will complete an internal circuit therein a predetermined time after proximity switch 93 has been actuated by metal screw 87 on that conveyor trough, and this will energize motor 104 to cause bag-carrying frame 52 to rise from its lower position of FIG. 18 to its upper position of FIG. 19 to thereby receive closed pads 112 and 113 within the mouth of open bag 61. More specifically, the PLC 94 closes a switch therein to bag-carrying frame motor 104 (FIGS. 1–3, 5 and 12–15) which is mounted on plate 105' secured to the outer end of arm 105 (FIG. 5) extending outwardly from frame member 29. A crank 107 (FIGS. 12–15) is secured to shaft 109 of motor 104, and proximity switches 110 and 111 are mounted on brackets secured to motor 104. Crank 107 is connected to one end 106 of arm 108 and the other end 106' of arm 108 is connected to an arm 53 of bag-carrying frame 52 through slotted plate 116 (FIGS. 3, 12 and 14). A clamping member 108' has a central portion 109' which extends through slot 116' in plate 116, and the clamping of central portion 109' in a desired position in slot 116' will determine the fine limit of movement of bag-carrying frame 52. The coarse limits of movement can be adjusted by threading arm 108 relative to arm ends 106 and 1061. When the open bag reaches the above-noted position wherein the leading portion of its open mouth receives closed pads 112 and 113 mounted on the underside of conveyor trough 14, the PLC will close its internal switch to thereby complete a circuit to motor 104 to thereby cause crank 107 to move from its lower position of FIG. 12 to its upper position of FIG. 14 and stop for a predetermined period of time, namely, approximately 0.14 seconds to thereby cause the open mouth of the bag 61 to receive closed pads 112 and 113 (FIG. 23). The stopping of motor 104 in its 180° position is due to the fact that proximity switch 110 causes PLC 94 to terminate the flow of current to motor 104, and the internal braking system associated with motor 104 will cause it to stop. Motor 104 is of the same type noted above relative to motor 79. While the carousel continues to rotate and while the bag-carrying frame 52 is in its upper position, pad 113 immediately thereafter is caused to move from its closed position of FIGS. 23 and 25 to its open position of FIGS. 24 and 26 away from stationary pad 112, as explained in detail hereafter.

Figure 29:
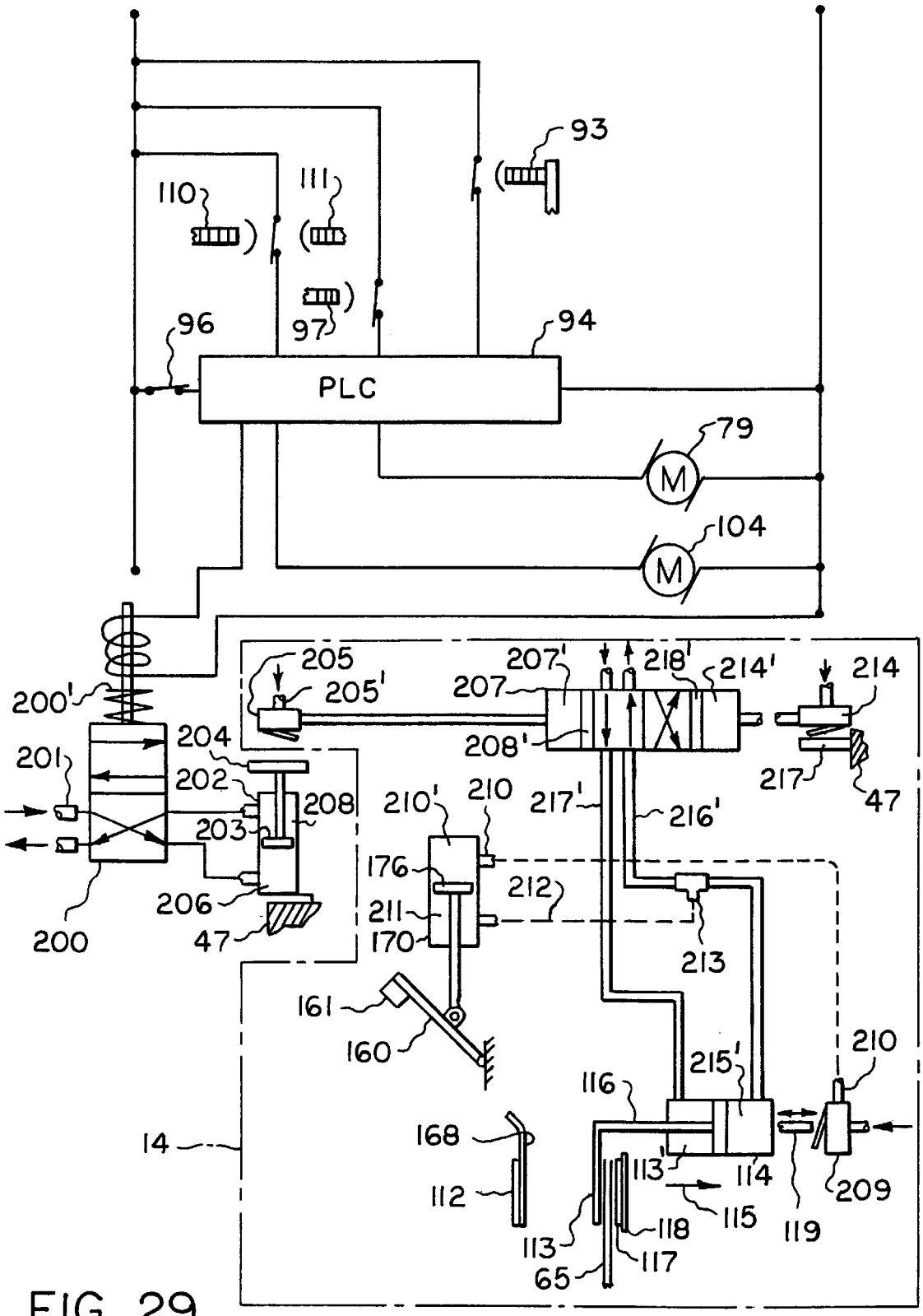
FIG. 29 is a schematic electrical and pneumatic diagram.

The carousel bagger 12 includes a pneumatic circuit (FIG. 29) which causes pad 113 to move rearwardly to clamp bag front side 65 between it and abutment 117 on bar 118 (FIG. 24) of the conveyor trough 14. Bar 118 extends between supports 117' (FIGS. 20, 20B, 20C, 21 and 22) which are welded to the undersides of frame portions 125. A predetermined time after proximity switch 93 has been actuated, the PLC 94 also momentarily energizes four-way valve 200 mounted on the frame of the carousel bagger 12 to route compressed air from conduit 201 leading from a compressor 198 (FIG. 28) mounted on the frame 47 of the carousel bagger 12, to chamber 206 of pneumatic cylinder 202, mounted on the frame 47 of the carousel bagger 12, to thereby momentarily raise piston 203 to cause pad 204 mounted thereon to actuate air switch 205 mounted on conveyor trough 14 as it rotates relative thereto. The position of valve 200 in FIG. 29 is its actuated position. However, it is normally in its other position under the bias of spring 200' so that after valve 200 has been momentarily actuated, it returns to its other position wherein the flow of compressed air from conduit 201 routes air to chamber 208 of cylinder 202 to thereby draw pad 204 downwardly. The momentary actuation of switch 205 will route compressed air from conduit 205' to chamber 207' of four-way valve 207 to cause piston 208' to move valve 207 to route compressed air to chamber 113' of pneumatic cylinder or motor 114 mounted on bar 114' (FIGS. 21–24), which has its opposite ends welded to frame portions 125 (FIG. 20C), to drive piston 116 in the direction of arrow 115 (FIG. 23) to in turn drive pad 113 mounted on the end thereof toward abutment 117 mounted on frame member 118 of the conveyor trough with bag side 65 therebetween.

The foregoing action will cause movable pad 113 to clamp the short side 65 of bag 61 against abutment 117 mounted on frame member 118 on the underside of conveyor trough 14. Pad 113 is guided for rectilinear movement by rods 119 (FIG. 22) which have ends 120 (FIG. 22) secured to the sides of pads 113 and which have their central portions guided through sleeves 121 mounted on bar 114' of the frame of the conveyor trough 14. Pad 112 is mounted on plate 168 which is mounted on bar 122 which is a portion of C-shaped subframe 123 having legs 124 (FIG. 22) which telescope into frame portions 125 so that the position of pad 112 can be adjusted relative to stationary pad 117 for different sizes of plastic bags and held in an adjusted position by screws 127.

Figure 26:
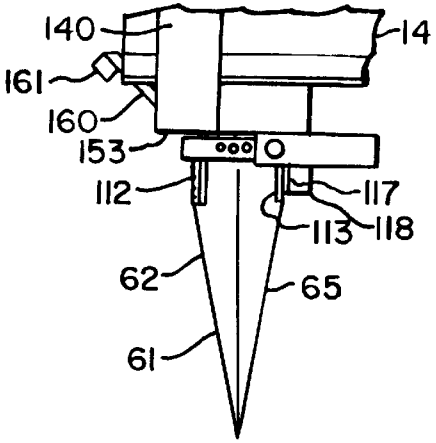
FIG. 26 is a schematic view showing a portion of FIG. 25 with the bag clamped on the conveyor trough by the bag-clamping mechanism.

During the foregoing movement of pad 113 into engagement with abutment 117, the rear side 62 of bag 61 will be ripped from wicket rods 59 because its upper portion 63 (FIG. 16) has slits 157 which extend downwardly to within one-eighth inch of wicket mounting holes 67, and these one-eight inch portions will be severed so that the rear bag side 62 with its extension 63 will be torn from wicket rods 59. Thereafter, the rear side 62 of bag 61 will be forced against stationary pad 112, as depicted in FIG. 26. At this time, immediately after the bag 61 has been fully removed from the bag assemblage 60, and while the conveyor trough 14 continues its rotation, the PLC 94 actuated motor 104 will cause crank 107 to return to its original position and thus return bag-carrying frame 52 to its lower position of FIG. 18 from its upper position of FIG. 19. The bag-carrying frame 52 will stop in its lower position because proximity switch III will cause PLC 94 to terminate the flow of current to motor 104, and the internal braking of motor 104 will cause it to stop in its precise lowermost position.

Figure 20A:
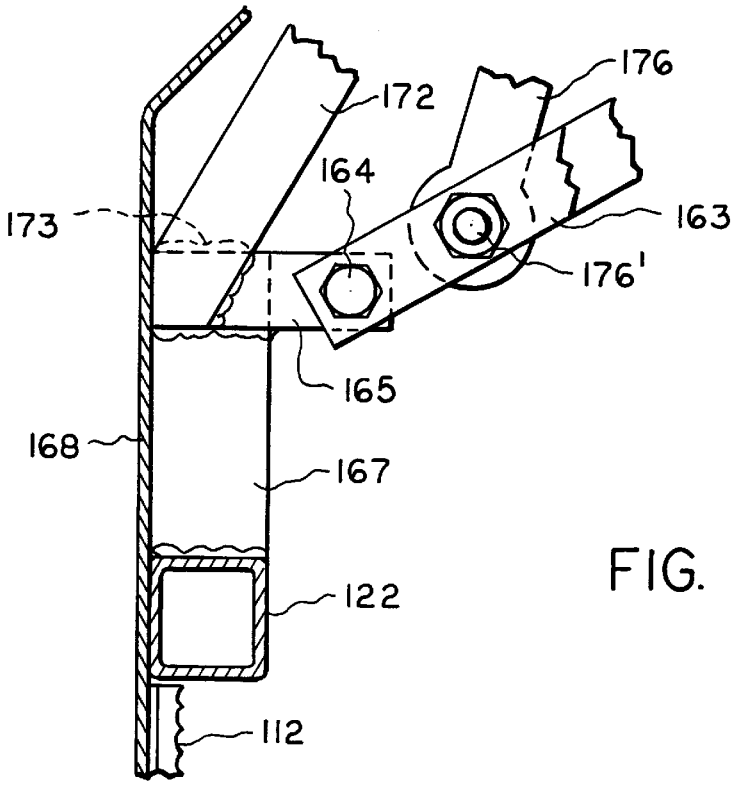
FIG. 20A is a fragmentary cross sectional view taken substantially along line 20A—20A of FIG. 20.
Figures 20B, 20C:
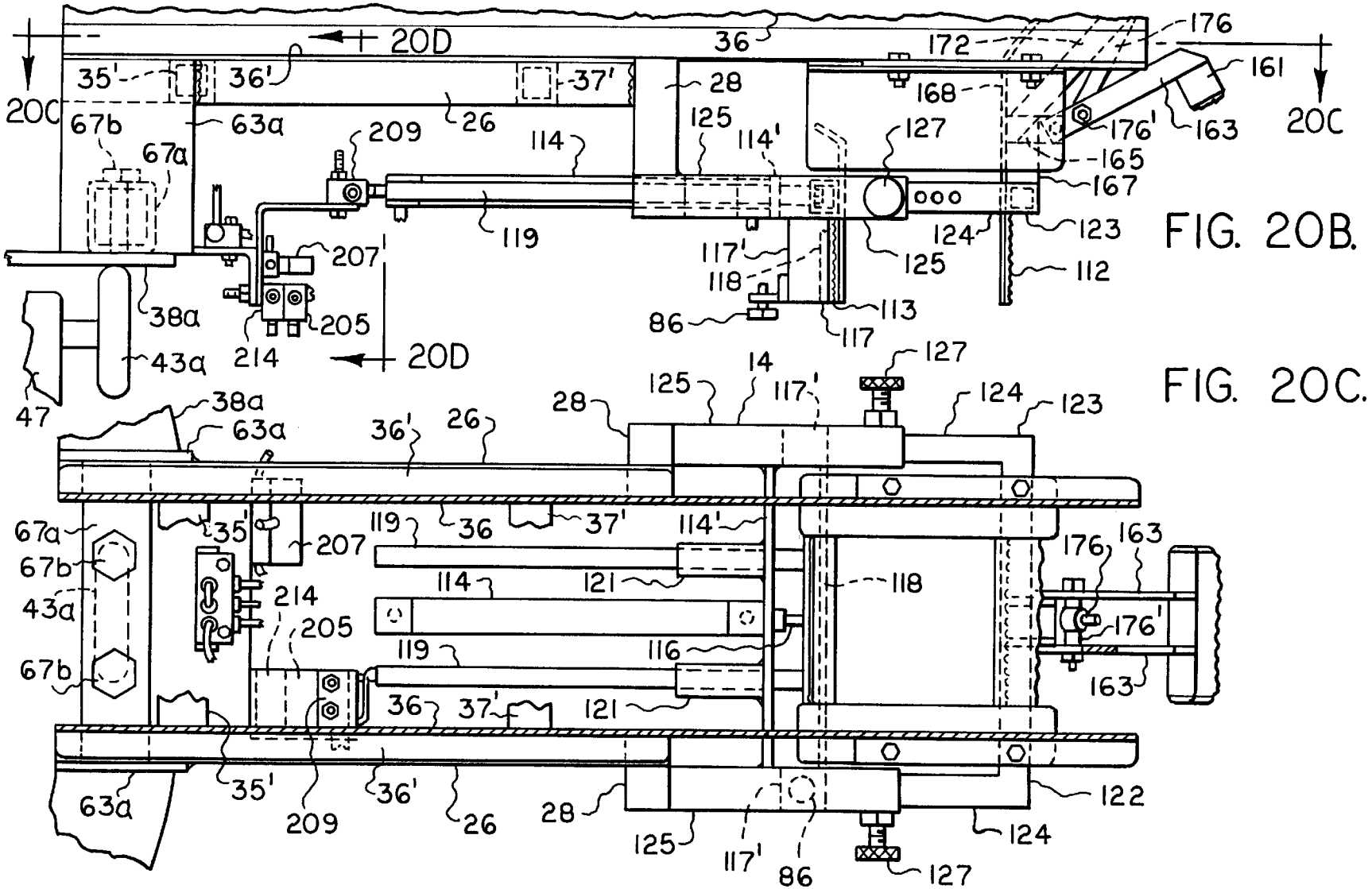
FIG. 20B is a fragmentary side elevational view of the lower portion of a conveyor chute taken substantially in the direction of arrows 20B—20B of FIG. 20.
FIG. 20C is a cross sectional view taken substantially along line 20C—20C of FIG. 20B.

After the bag-carrying frame 52 has been lowered and as the conveyor trough 14 continues its rotation, clamping arm 160 (FIGS. 3, 20, 21 23 and 24) will be actuated to drive clamping pad 161 into engagement with stationary pad 112 with the upper edge 162 (FIG. 24) of bag side 62 therebetween. More specifically, clamping arm 160 consists of two arms 163 (FIGS. 20, 20A, 21, 23 and 24) which have their ends pivotally mounted at 164 on tabs 165 (FIGS. 20A, 21 and 23) extending outwardly from bar 167 mounted on plate 168 which is secured to bar 122 of conveyor trough 14. The opposite ends of arms 163 are welded to pad 161 at 169 (FIG. 21). The arm 160 is moved between its unclamping position of FIG. 23 to its clamping position of FIG. 24 by pneumatic cylinder or motor 170 which has its upper end pivotally mounted at 171 on link 172, the lower end of which is welded at 173 to the side of tab 165 which is welded to bar 167 (FIG. 20A). The pneumatic motor 170 is caused to move from its position of FIG. 23 to its position of FIG. 24 immediately after bag-carrying frame 52 moves to its lower position, and the clamping is complete before the clamped bag reaches its position underneath hopper 115.

In order to effect the foregoing movement which clamps the rear side 62 of bag 61 between pad 112 on plate 168 and pad 161, the pneumatic circuit operates in the following manner. A pneumatic switch 209 (FIGS. 20B, 20C, 20D and 29) is mounted on the frame of the conveyor trough 14, and when rod 119 moves to a position wherein pad 113 clamps the front side 65 of bag 61 to abutment 117, the end of rod 119 will actuate switch 209 (FIG. 20C) mounted on conveyor trough 14 which will route compressed air from conduit 210 to chamber 210' of pneumatic cylinder 170 to thereby drive piston 176, which is pivotally mounted to pin 176' (FIGS. 20A and 21) which extends between arms 163, downwardly to effect the clamping of bag side 65 between pads 161 and 112,as noted above. At the same time, the chamber 211 of cylinder 170 will be exhausted through conduit 212, tee 213, conduit 216' and four-way valve 207.

As the conveyor trough 14 continues its rotation beyond the bag-mounting operation described above, an electric eye 215 (FIGS. 1 and 28) mounted on the frame of the bagger 12 will detect if a bag 61 is properly hung on the conveyor trough 14, and, if it is, the proximity switch 93, by detecting the position of a conveyor trough then passing It in combination with the signal from electric eye 215, will indirectly be sensing the position of another conveyor trough 14 relative the hopper 15, and the PLC will cause the hopper 15 to release a load of produce. If the electric eye does not detect that a bag is properly hung on a conveyor trough, hopper 15 will not release a load of produce.

After the produce 177 has been loaded into a bag 61, as described above, the carousel bagger 12 continues its rotation, and four-way valve 207 is reset in the following manner. An air switch 214 (FIGS. 20B, 20C and 29), which is mounted on each conveyor trough 14, will be triggered by engaging a protrusion 217 (FIGS. 28 and 29) on the frame 47 of the bagger 12 to thereby momentarily route air to chamber 214' of four-way valve 207 and cause piston 218' to reset valve 207. Protrusion 217 is located 180° from hopper 15. After four-way valve 207 has been reset, compressed air will be routed to chamber 215' of cylinder 114 and chamber 113' will be exhausted through conduit 217' so that cylinder 114 will return pad 113 back to a position adjacent stationary pad 112, and the accompanying movement of rod 119 will release air switch 209, and thus air can be routed from four-way valve 207 to conduit 216' and tee 213 and through conduit 212 to chamber 211 of cylinder 170 to thereby raise pad arm 160 to its position of FIG. 23. Chamber 210' of cylinder 170 is vented through conduit 210 and valve 209, which is vented when it is not actuated by rod 119. Valves 205 and 214 are also vented when they are not actuated. The four-way valve 200 is spring-biased by spring 200' to a position wherein the air flow therethrough maintains piston 203 of cylinder 202 in a down position wherein pad 204 is not in a position to actuate air switch 205. As noted above, the actuation of four-way valve 200 by PLC 94 is only momentary. Therefore, once four-way valve 207 has been shifted by the air switch 205, as explained above, it remains in a thus shifted position until it is shifted back to its other position by air switch 214, as also explained above.

A loaded bag 61 is released after the above-described bag clamping structure has been returned to a position for receiving another bag. The released bag 61 can then be handled in any desired manner by commercially available units which may seal the top of the bag and convey it away from the carousel bagger 12.

While preferred embodiments of the present invention have been disclosed, it will be appreciated that the present invention is not limited thereto but may be otherwise embodied within the scope of the following claims.

What is claimed is:

1. A conveyor trough comprising a trough frame, spaced sides extending upwardly from said trough trame, a conveyor between said spaced sides, an outer dispensing end and an inner end remote therefrom on said trough frame, a first pad fixedly mounted on said outer dispensing end of said trough frame, a second pad on said trough frame between said first pad and said inner end of said trough frame, an abutment on said trough frame between said second pad and said inner end of said trough frame, a first motor coupled to said second pad for moving said second pad toward and away from said first pad and into and out of engagement with said abutment, a third pad located on the opposite side of said first pad from said second pad, and a second motor mounted on said outer dispensing end of said trough frame and coupled to said third pad for moving said third pad into and out of engagement with said first pad.

2. A conveyor trough as set forth in claim 1 wherein said first motor is a first pneumatic cylinder, and wherein said second motor is a second pneumatic cylinder.

3. A conveyor trough as set forth in claim 2 wherein said first pneumatic cylinder is mounted in a substantially horizontal attitude on said frame, and wherein said second motor is mounted in a generally vertical attitude on said frame.

4. A conveyor trough as set forth in claim 2 including a source of compressed air, a first air switch on said trough frame, a main frame mounting said trough frame, a member on said main frame for selectively actuating said first air switch, a first conduit in effective communication between said source of compressed air and said first pneumatic cylinder for supplying air to said first pneumatic cylinder to move said second pad into engagement with said abutment, a second air switch on said trough frame actuated by said first pneumatic cylinder, and a second conduit in effective communication between said source of compressed air and said second pneumatic cylinder to supply air to said second pneumatic cylinder to move said third pad into engagement with said first pad.

5. A conveyor trough as set forth in claim 4 including a third air switch on said trough frame, a protrusion on said main frame for actuating said third air switch, a third conduit in effective communication between said source of compressed air and said first pneumatic cylinder for supplying air to said first pneumalic cylinder to move said second pad toward said first pad, and a fourth conduit in effective communication between said source of compressed air and said second pneumatic cylinder to supply air to said second pneumatic cylinder to move said third pad away from said first pad.

6. A conveyor trough as set forth in claim 5 including a four-way valve between said compressed air source and said first, third and fourth conduits.

7. A conveyor trough as set forth in claim 6 wherein said first air switch and said third air switch selectively actuate said four-way valve.

8. A carousel-type of bag-filling machine comprising a frame, a plurality of conveyor troughs mounted on said frame, each of said conveyor troughs including a trough frame, spaced sides extending upwardly from said trough frame, a conveyor between said spaced sides, an outer dispensing end and an inner end remote therefrom on said trough frame, a first pad fixedly mounted on said outer dispensing end of said trough frame, a second pad on said trough frame between said first pad and said inner end of said trough frame, an abutment on said trough frame between said second pad and said inner end of said trough frame, a first motor coupled to said second pad for moving said second pad toward and away from said first pad and into and out of engagement with said abutment, a third pad located on the opposite side of said first pad from said second pad, and a second motor mounted on said outer dispensing end of said trough trame and coupled to said third pad for moving said third pad into and out of engagement with said first pad.

9. A carousel type of bag-filling machine as set forth in claim 8 including a plate mounted between sides of adjacent conveyor troughs at said outer dispensing ends, and an air duct extending downwardly from each of said plates.

10. A carousel type of bag-filling machine as set forth in claim 9 including a second plate mounted across said outer dispensing end of each of said conveyor troughs.

11. A carousel type of bag-filling machine as set forth in claim 10 including a blower mounted on said frame above said first and second plates and in line with said air duct.

* * * * *